US011957955B1

(12) United States Patent
Liu et al.

(10) Patent No.: US 11,957,955 B1
(45) Date of Patent: Apr. 16, 2024

(54) ELECTRIC LIFTING SLOPE ADJUSTMENT DEVICE HAVING VIBRATION DAMPING FUNCTION AND TREADMILL

(71) Applicant: Shenzhen Yile Dynamic Technology Co., LTD, Guangdong (CN)

(72) Inventors: Ren Liu, Guangdong (CN); Jinsong Fan, Guangdong (CN)

( * ) Notice: Subject to any disclaimer, the term of this patent is extended or adjusted under 35 U.S.C. 154(b) by 0 days.

(21) Appl. No.: 18/396,139

(22) Filed: Dec. 26, 2023

(30) Foreign Application Priority Data

Dec. 7, 2023 (CN) ..... 202323331073.2

(51) Int. Cl.
*A63B 22/02* (2006.01)
*A63B 24/00* (2006.01)

(52) U.S. Cl.
CPC ..... *A63B 22/0221* (2015.10); *A63B 24/0087* (2013.01); *A63B 2225/093* (2013.01)

(58) Field of Classification Search
CPC ..... A63B 22/0235; A63B 22/0221; A63B 22/0228; A63B 24/00; A63B 24/0087; A63B 2225/093; Y10S 482/908
See application file for complete search history.

(56) References Cited

U.S. PATENT DOCUMENTS

| | | | | |
|---|---|---|---|---|
| 7,563,203 | B2 | 7/2009 | Dalebout et al. | |
| 9,937,375 | B2 | 4/2018 | Zhu | |
| 10,369,405 | B2 | 8/2019 | Zhu | |
| 2006/0287163 | A1* | 12/2006 | Wang | A63B 22/0235 482/54 |
| 2007/0225127 | A1* | 9/2007 | Pan | A63B 22/02 482/54 |
| 2008/0318737 | A1* | 12/2008 | Chu | A63B 22/02 482/54 |
| 2009/0088301 | A1* | 4/2009 | Alling | A63B 22/0235 482/54 |

* cited by examiner

*Primary Examiner* — Andrew S Lo
*Assistant Examiner* — Andrew M Kobylarz

(57) ABSTRACT

Provided is an electric lifting slope adjustment device having a vibration damping function and a treadmill. The electric lifting slope adjustment device includes: two lifting supports, a rotating shaft, a driving component and a vibration damping assembly; each of the lifting supports has a rotating end, and the rotating ends of the two lifting supports are rotatably connected to a first inner wall and a second inner wall respectively; the driving component is hinged to a third inner wall, the driving component includes a lifting motor and a lifting rod, a driving end of the lifting motor is connected to the lifting rod; the vibration damping assembly includes a mounting frame and a vibration damping spring, and a compression direction of the vibration damping spring is perpendicular to an axis of the rotating shaft.

10 Claims, 8 Drawing Sheets

ELECTRIC LIFTING SLOPE ADJUSTMENT DEVICE HAVING VIBRATION DAMPING FUNCTION AND TREADMILL

CROSS REFERENCE TO RELATED APPLICATION

This application claims priority benefit of Chinese utility model Application No. 202323331073.2, filed on Dec. 7, 2023, and the entire contents of which are incorporated herein by reference.

TECHNICAL FIELD

The present invention relates to the technical field of treadmills, and in particular, to an electric lifting slope adjustment device having a vibration damping function and a treadmill.

BACKGROUND

Treadmills, as an aerobic exercise equipment, has become increasingly popular among consumers after being introduced to the market. The treadmills can exercise user's physical fitness, endurance and cardiopulmonary function, achieving scientific exercise goals.

Most of the treadmills currently available on the market have a slope adjustment function, and users can set the slope of a running platform of the treadmill by themselves to adjust the intensity of exercise.

However, during the lifting process of a lifting mechanism of the treadmill, there will be a certain degree of shaking phenomenon. The shaking generated during the lifting process not only causes damage to the user's knee and ankle joints, but also affects the service life of a lifting motor. Therefore, how to reasonably solve the shaking generated by the lifting mechanism of the treadmill during the lifting process is a technical problem to be solved urgently at present.

SUMMARY

An object of the present invention is to provide an electric lifting slope adjustment device having a vibration damping function and a treadmill, so as to effectively solve the problem of shaking of a lifting mechanism of the treadmill during the lifting process.

In order to achieve the above purpose, the present disclosure provides the following technical solution.

In a first aspect of the present invention, provided is an electric lifting slope adjustment device having a vibration damping function. The electric lifting slope adjustment device having a vibration damping function is applied to a treadmill, the treadmill comprises a frame and a running platform, the frame is a rectangular frame and has a first inner wall, a second inner wall and a third inner wall, the first inner wall and the second inner wall are arranged opposite each other, the third inner wall is parallel to a first direction and is perpendicular to the first inner wall and the second inner wall respectively, and the running platform is provided between the first inner wall and the second inner wall; the electric lifting slope adjustment device having a vibration damping function comprises two lifting supports, a rotating shaft, a driving component and a vibration damping assembly; each of the lifting supports has a rotating end, the rotating ends of the two lifting supports are rotatably connected to the first inner wall and the second inner wall respectively; the rotating shaft extends along the first direction, two ends of the rotating shaft in an extending direction are respectively connected to the two lifting supports; the driving component is hinged to the third inner wall, the driving component comprises a lifting motor and a lifting rod, the lifting rod extends along a second direction perpendicular to the first direction, and a driving end of the lifting motor is connected to the lifting rod, so that the lifting rod can extend and retract reciprocally along an extending direction thereof; the vibration damping assembly comprises a mounting frame and a vibration damping spring, the mounting frame is connected to the rotating shaft and is hinged to an end portion of the lifting rod close to the rotating shaft, a compression direction of the vibration damping spring is perpendicular to an axis of the rotating shaft, and two ends of the vibration damping spring are respectively connected to the mounting frame and the end portion of the lifting rod close to the rotating shaft.

Further, the vibration damping assembly further comprises a hinging frame, the mounting frame has a first surface, the hinging frame has a second surface, one end of the hinging frame is hinged to the mounting frame so as to form a vibration damping space between the first surface and the second surface, the vibration damping spring is provided in the vibration damping space, two ends of the vibration damping spring in the compression direction are respectively connected to the first surface and the second surface, and the end portion of the lifting rod close to the rotating shaft is hinged to the other end of the hinging frame.

Further, the driving component further comprises a swinging sleeve, an inner portion of the swinging sleeve has a telescopic space, the telescopic space and the lifting rod extend in the same direction, the swinging sleeve is sleeved on an end portion of the lifting rod away from the rotating shaft, and an end portion of the swinging sleeve away from the rotating shaft is hinged to the third inner wall.

Further, each of the lifting supports comprises a first part and a second part, and an included angle is formed between the first part and the second part, the rotating end of each of the lifting supports is provided at an end portion of the first part away from the second part corresponding to the first part, a roller is rotatably connected to the second part of each of the lifting supports, and two ends of the rotating shaft in the extending direction are connected to the first parts of the two lifting supports respectively.

In a second aspect of the present invention, provided is an electric lifting slope adjustment device having a vibration damping function. The electric lifting slope adjustment device having a vibration damping function is applied to a treadmill, the treadmill comprises a frame and a running platform, the frame is a rectangular frame and has a first inner wall, a second inner wall and a third inner wall, the first inner wall and the second inner wall are arranged opposite each other, the third inner wall is parallel to a first direction and is perpendicular to the first inner wall and the second inner wall respectively, and the running platform is provided between the first inner wall and the second inner wall; the electric lifting slope adjustment device having a vibration damping function comprises two lifting supports, a rotating shaft, a driving component and a vibration damping assembly; each of the lifting supports has a rotating end, the rotating ends of the two lifting supports are rotatably connected to the first inner wall and the second inner wall respectively; the rotating shaft extends along the first direction, two ends of the rotating shaft in an extending direction are respectively connected to the two lifting supports; the driving component is hinged to the third inner wall, the driving component comprises a lifting motor and a lifting rod, the lifting rod extends along a second direction, and a driving end of the lifting motor is connected to the lifting rod, so that the lifting rod can extend and retract reciprocally along an extending direction thereof; the vibration damping assembly comprises a mounting frame and a vibration damping block, the mounting frame is connected to the rotating shaft and is hinged to an end portion of the lifting rod close to the rotating shaft, the vibration damping block extends along an axial direction perpendicular to the rotating shaft, and two ends of the vibration damping block in the extending direction are respectively connected to the mounting frame and the end portion of the lifting rod close to the rotating shaft.

Further, the vibration damping assembly further comprises a hinging frame, the mounting frame has a first surface, the hinging frame has a second surface, one end of the hinging frame is hinged to the mounting frame so as to form a vibration damping space between the first surface and the second surface, the vibration damping block is provided in the vibration damping space, two ends of the vibration damping block in the compression direction are respectively connected to the first surface and the second surface, and the end portion of the lifting rod close to the rotating shaft is hinged to the other end of the hinging frame.

Further, the driving component further comprises a swinging sleeve, an inner portion of the swinging sleeve has a telescopic space, the telescopic space and the lifting rod extend in the same direction, the swinging sleeve is sleeved on an end portion of the lifting rod away from the rotating shaft, and an end portion of the swinging sleeve away from the rotating shaft is hinged to the third inner wall.

Further, the vibration damping block is made of an elastic hard material.

Further, each of the lifting supports comprises a first part and a second part, and an included angle is formed between the first part and the second part, the rotating end of each of the lifting supports is provided at an end portion of the first part away from the second part corresponding to the first part, a roller is rotatably connected to the second part of each of the lifting supports, and two ends of the rotating shaft in the extending direction are connected to the first parts of the two lifting supports respectively.

A third aspect of the present invention provides a treadmill. The treadmill comprises any one of the electric lifting slope adjustment device having a vibration damping function provided by the first aspect and/or the second aspect of the present invention.

It can be seen through analysis that the present invention discloses an electric lifting slope adjustment device having a vibration damping function. The electric lifting slope adjustment device having a vibration damping function can drive a lifting rod to move back and forth along a second direction by means of a motor so as to drive, by means of a mounting frame hinged to an end portion of the lifting rod, a rotating shaft extending along a first direction to rotate, so that the lifting supports connected to the two ends of the rotating shaft in the extension direction rotates around the respective rotating ends thereof, thereby achieving the slope adjustment of a running platform of a treadmill. During the slope adjustment process, the pressure exerted by the user on the running platform and the shaking generated during the slope adjustment can be offset by the elastic deformation of the vibration damping spring, thereby effectively achieving the effect of damping vibration.

BRIEF DESCRIPTION OF DRAWINGS

The accompanying drawings, which form a part of the present application, are used to provide a further understanding of the present invention. The schematic embodiments of the present invention and the description thereof are used to explain the present invention, and do not form improper limits to the present invention. In the drawings.

Figure 1:
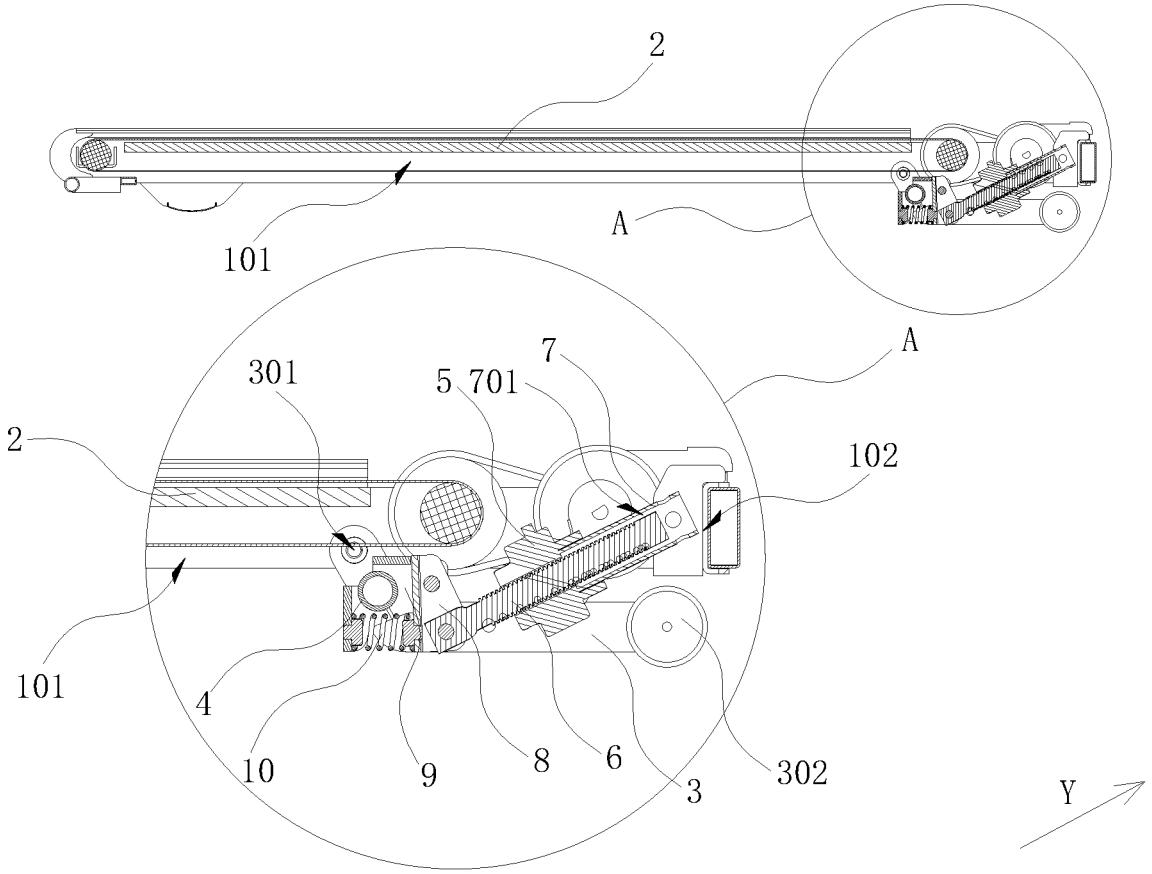
FIG. 1 is a sectional schematic diagram of a first operation state of an electric lifting slop adjustment device having a vibration reduction function provided by a first embodiment of the present invention.

Description of reference signs: 1. frame; 101. first inner wall; 102. third inner wall; 2. running platform; 3. lifting support; 301. rotating end; 302. roller; 4. rotating shaft; 5. lifting motor; 6. lifting rod; 7. swinging sleeve; 701. telescopic space; 8. hinging frame; 9. mounting frame; 10. vibration damping spring; 11. vibration damping block; X. first direction; and Y. second direction.

DESCRIPTION OF EMBODIMENTS

The present invention will be described below with reference to the drawings and embodiments in detail. The respective examples are provided by way of explanation of the present invention without limiting the present invention. Indeed, it will be apparent to a person skilled in the art that modifications and variations can be made in the present invention without departing from the scope or spirit of the invention. For example, features shown or described as part of one embodiment may be used in another embodiment to produce yet another embodiment. Therefore, it is expected that the present invention includes such modifications and variations within the scope of the accompanying claims and their equivalent.

In the description of the present invention, orientation or position relationships indicated by terms such as "longitudinal", "lateral", "up", "down", "front", "rear", "left", "right", "vertical", "horizontal", "top", and "bottom" are based on orientation or position relationships shown in the accompanying drawings, which are only used to facilitate description of the present invention rather than requiring that the present invention must be constructed and operated in a specific orientation, and therefore cannot be construed as a limitation on the present invention. The terms "connecting", "connected" and "provided" used in the present invention should be understood broadly, for example, may be fixedly connected, and may also be detachably connected; may also be direct connections or indirect connections via intervening components; may also be wired connections or radio connections; and may also be wireless communication signal connections. A person of ordinary skill in the art would have been able to understand the specific meaning of the described terms according to specific situations.

One or more examples of the present invention are illustrated in the accompanying drawings. The detailed description uses numerals and letter markings to refer to features in the drawings. Similar or like reference signs in the drawings and descriptions have been used to refer to similar or like parts of the present invention. As used herein, the terms "first", "second" and "third" and the like are used interchangeably to distinguish one member from another and are not intended to denote the location or importance of individual members.

Figure 2:
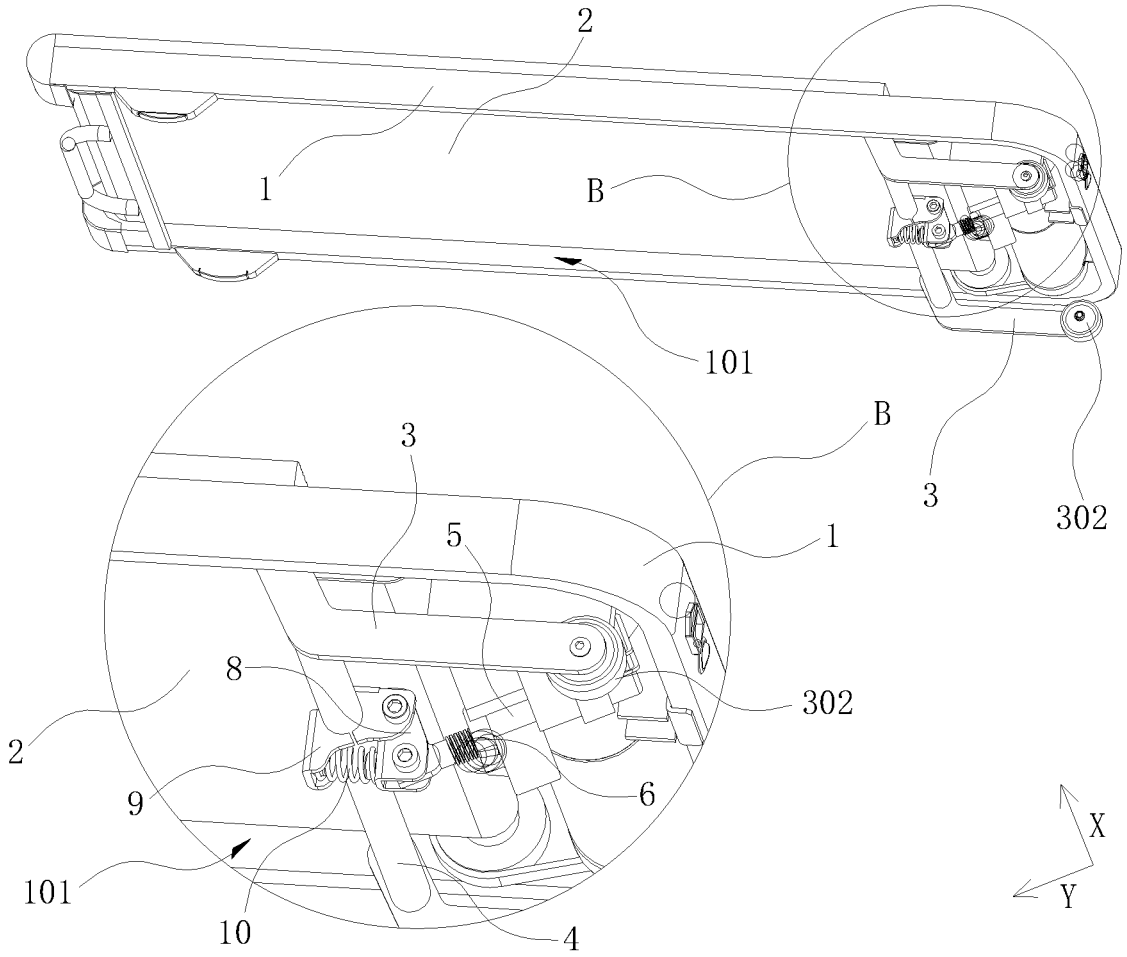
FIG. 2 is an axis-side schematic diagram of in a first operation state of an electric lifting slop adjustment device having a vibration reduction function provided by a first embodiment of the present invention.
Figure 3:
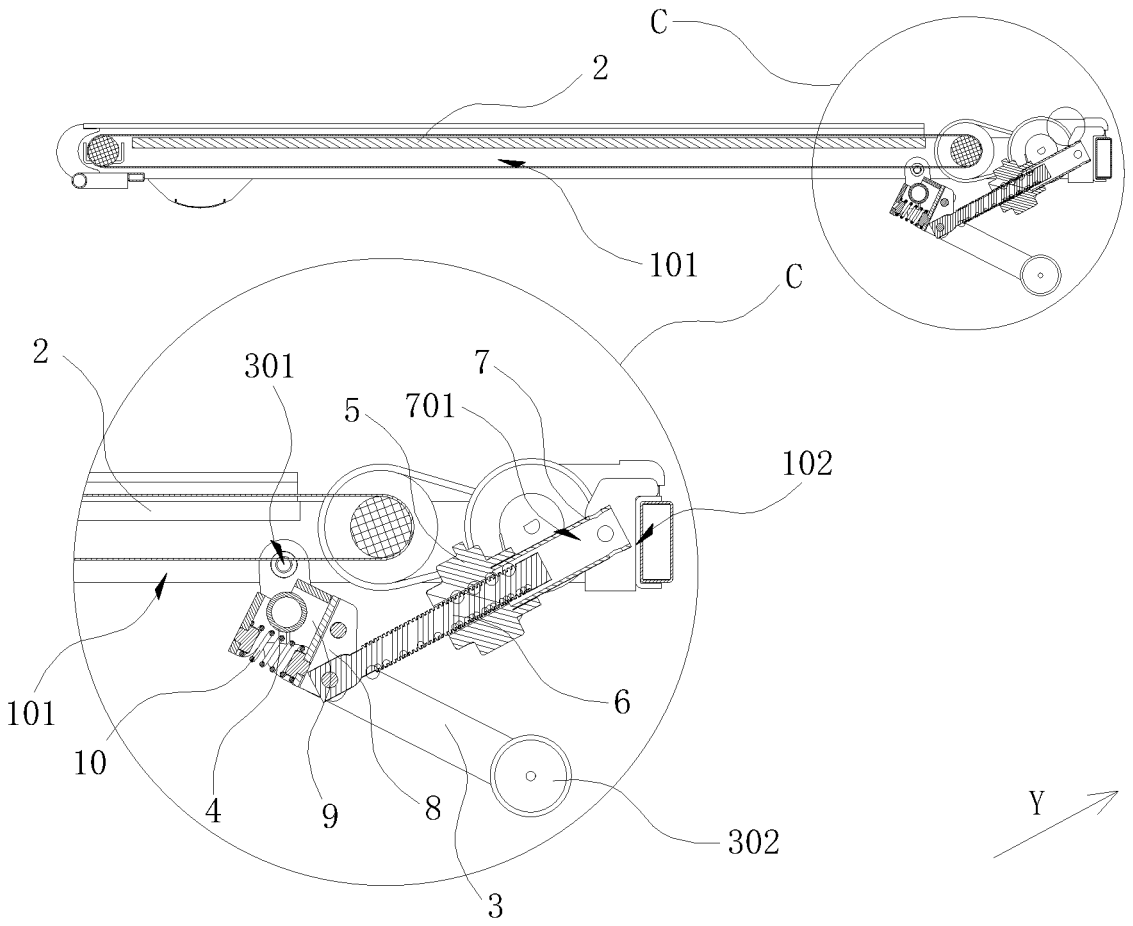
FIG. 3 is a sectional schematic diagram of a second operation state of an electric lifting slop adjustment device having a vibration reduction function provided by a first embodiment of the present invention.
Figure 4:
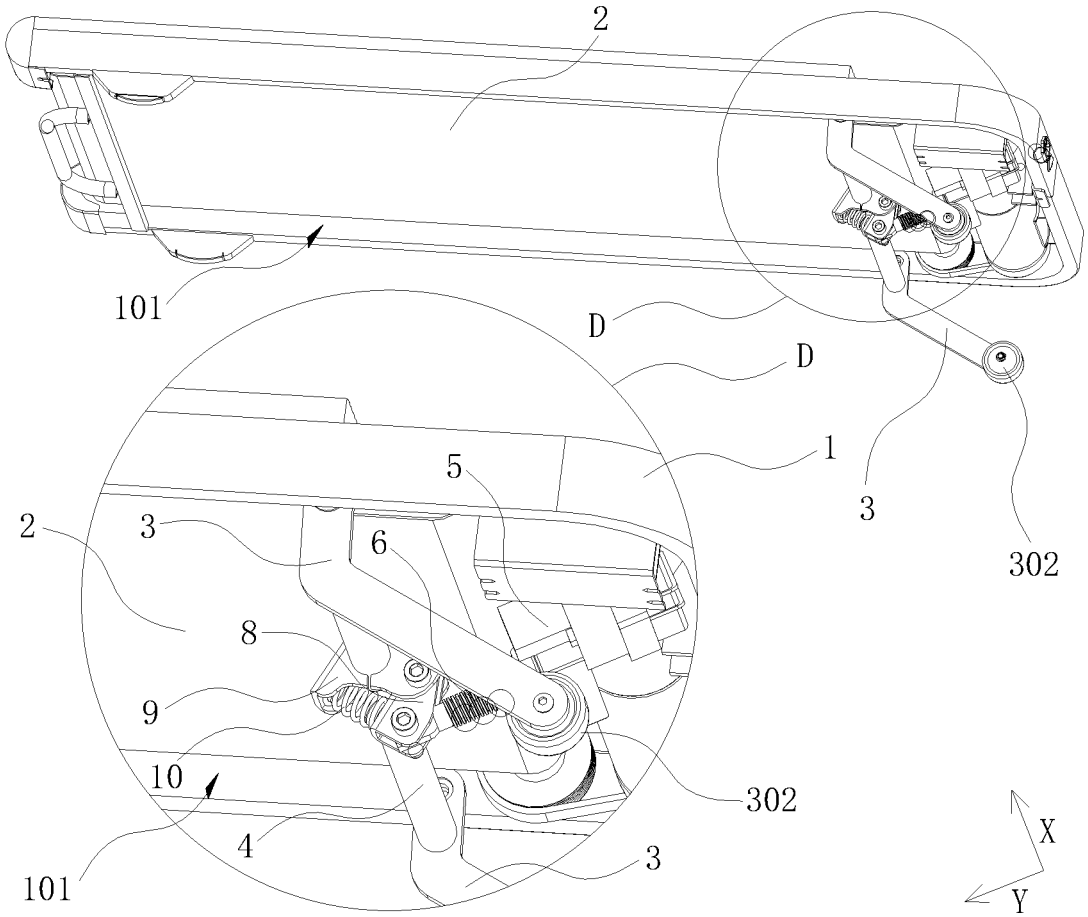
FIG. 4 is an axis-side schematic diagram of a second operation state of an electric lifting slop adjustment device having a vibration reduction function provided by a first embodiment of the present invention.

As shown in FIG. 1 to FIG. 4, a first embodiment of the present invention provides an electric lifting slope adjustment device having a vibration damping function. The electric lifting slope adjustment device having a vibration damping function is applied to a treadmill, the treadmill comprises a frame 1 and a running platform 2, the frame 1 is a rectangular frame and has a first inner wall 101, a second inner wall and a third inner wall 102, the first inner wall 101 and the second inner wall are arranged opposite each other, the third inner wall 102 is parallel to a first direction X and is perpendicular to the first inner wall 101 and the second inner wall respectively, and the running platform 2 is provided between the first inner wall 101 and the second inner wall; the electric lifting slope adjustment device having a vibration damping function comprises two lifting supports 3, a rotating shaft 4, a driving component and a vibration damping assembly; each of the lifting supports 3 has a rotating end 301, the rotating ends 301 of the two lifting supports are rotatably connected to the first inner wall 101 and the second inner wall respectively; the rotating shaft 4 extends along the first direction X, two ends of the rotating shaft 4 in an extending direction are respectively connected to the two lifting supports 3; the driving component is hinged to the third inner wall 102, the driving component comprises a lifting motor 5 and a lifting rod 6, the lifting rod 6 extends along a second direction Y perpendicular to the first direction X, and a driving end of the lifting motor 5 is connected to the lifting rod 6, so that the lifting rod 6 can extend and retract reciprocally along an extending direction thereof; the vibration damping assembly comprises a mounting frame 9 and a vibration damping spring 10, the mounting frame 9 is connected to the rotating shaft 4 and is hinged to an end portion of the lifting rod 6 close to the rotating shaft 4, a compression direction of the vibration damping spring 10 is perpendicular to an axis of the rotating shaft 4, and two ends of the vibration damping spring 10 are respectively connected to the mounting frame 9 and the end portion of the lifting rod 6 close to the rotating shaft 4.

Preferably, the driving component comprises a lifting motor 5, a lifting rod 6 and a swinging sleeve 7, the lifting rod 6 has a threaded lead screw structure and extends along the second direction Y, a stepping motor can be selected as the lifting motor 5, the axis of an output shaft of the lifting motor is parallel to the axis of the lifting rod 6, the output shaft of the lifting motor 5 can be connected to a transmission nut by means of a synchronous belt assembly or a gear assembly, the transmission nut matches with the thread of the lifting rod 6 and is screwed to the lifting rod 6, so that the lifting rod 6 can be driven to move back and forth along its own extending direction of the lifting rod by means of the action of thread meshing when the output shaft of the lifting motor 5 is working. The swinging sleeve 7 has a cylindrical structure extending along the same direction as the lifting rod 6. The swinging sleeve 7 has a telescopic space 701 inside, so that the swinging sleeve 7 can be sleeved outside the lifting rod 6, and the lifting rod 6 can move in the telescopic space 701 inside the swinging sleeve 7. An end portion of the swinging sleeve 7 away from the lifting rod 6 in the extending direction is hinged to the third inner wall 102 of the frame 1 by means of a hinging structure.

Preferably, each of the lifting supports 3 has a boomerang-shaped structure having an included angle, each of the lifting supports 3 has a first part and a second part, the first part and the second part are integrally formed, and the included angle is formed between the first part and the second part. An end portion of the first part away from the second part is a rotating end 301, the rotating ends 301 of the two lifting supports 3 are rotatably connected to the first inner wall 101 and the second inner wall of the frame 1 by means of a bearing assembly respectively, the two lifting supports 3 are respectively provided at the bottom of the running platform 2, and the first parts of the two lifting supports 3 are connected by means of a rotating shaft 4 extending along the first direction X.

Preferably, a mounting frame 9 is clamped on a circumferential surface of the rotating shaft 4, a hinging frame 8 is rotatably connected to the mounting frame 9 by means of a pin structure, both the mounting frame 9 and the hinging frame 8 are bent sheet metal parts, the mounting frame 9 and the hinging frame 8 respectively have a first surface and a second surface opposite to each other, and a vibration damping space for mounting the vibration damping spring 10 is formed between the first surface and the second surface. The hinging frame 8 is hinged to an end portion of the lifting rod 6 close to the rotating shaft 4 by means of a pin structure; when the lifting rod 6 moves along an extending direction thereof, the hinging frame 8 hinged to the end portion of the lifting rod 6 changes an angle, so as to drive the angle of the mounting frame 9 hinged to the hinging frame 8 to change; the mounting frame 9 drives the rotating shaft 4 to rotate, and finally drives the two lifting supports 3 connected to two ends of the rotating shaft 4 to rotate around their respective rotating ends 301, so as to achieve the angle adjustment of the running platform 2. During the angle adjustment process of the running platform 2, a vibration damping spring 10 provided between the mounting frame 9 and the hinging frame 8 can counteract shaking generated during the angle adjustment by means of elastic compression. When the user applies pressure to the running platform 2, the vibration damping spring 10 can also counteract the pressure transmitted from the rotating shaft 4 to the lifting motor 5 by means of elastic compression.

Preferably, a roller 302 is rotatably connected to an end portion of the second part of each of the lifting supports 3 away from the first part, and the roller 302 can adopt a rubber coated wheel structure.

Figure 5:
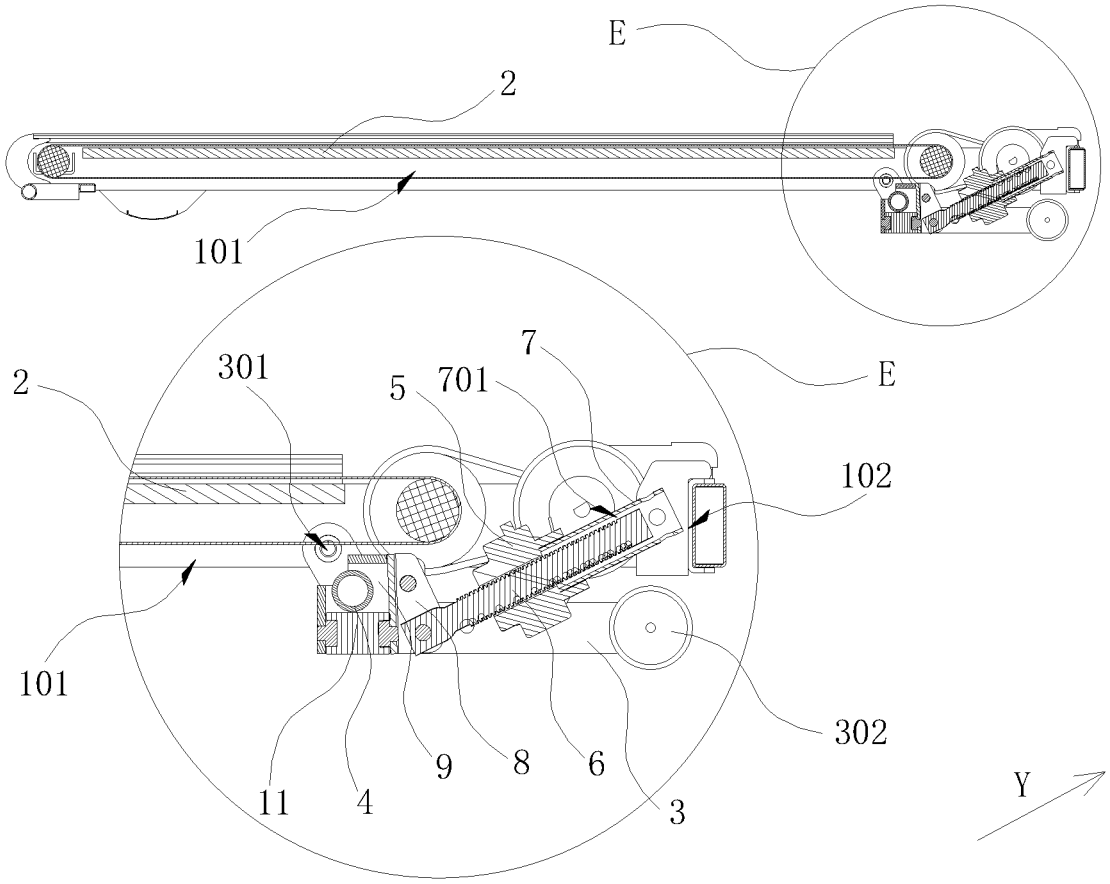
FIG. 5 is a sectional schematic diagram of a first operation state of an electric lifting slop adjustment device having a vibration reduction function provided by a second embodiment of the present invention.
Figure 6:
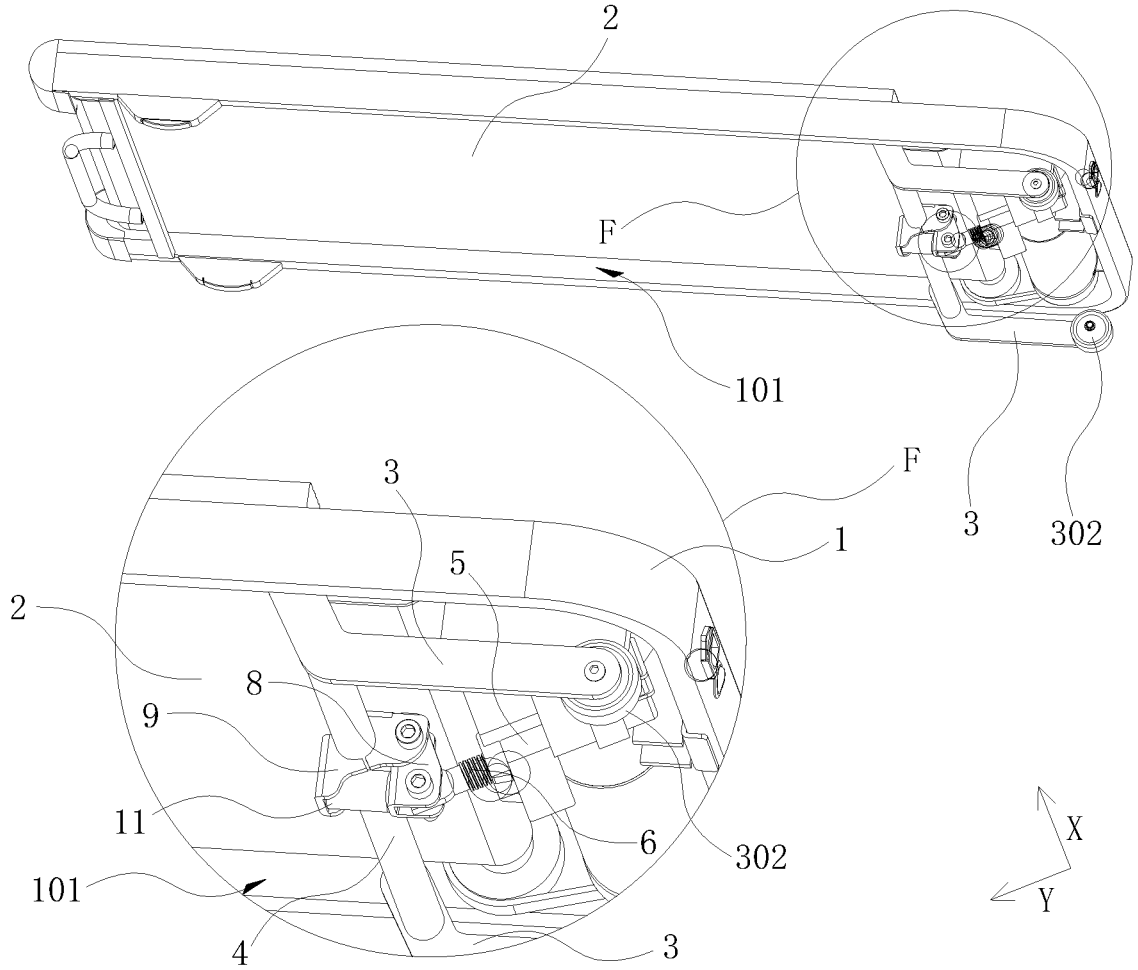
FIG. 6 is an axis-side schematic diagram of a first operation state of an electric lifting slop adjustment device having a vibration reduction function provided by a second embodiment of the present invention.
Figure 7:
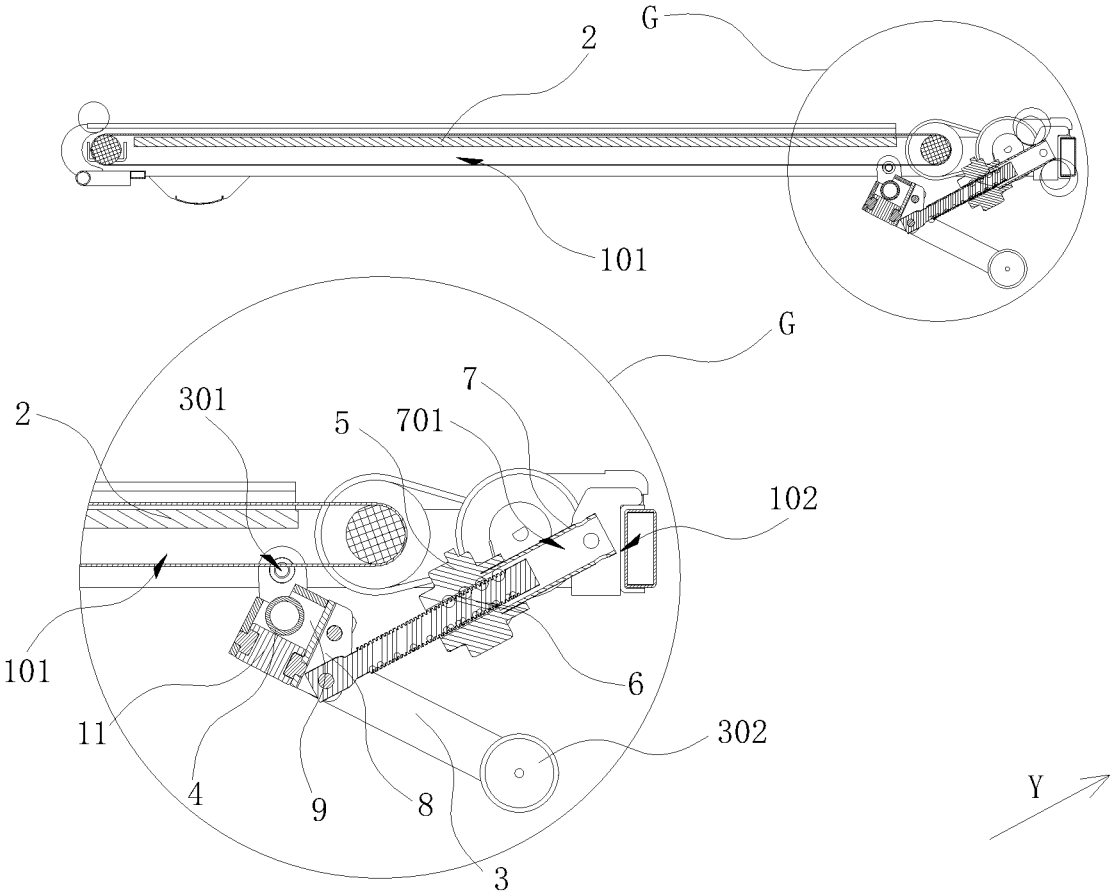
FIG. 7 is a sectional schematic diagram of a second operation state of an electric lifting slop adjustment device having a vibration reduction function provided by a second embodiment of the present invention.
Figure 8:
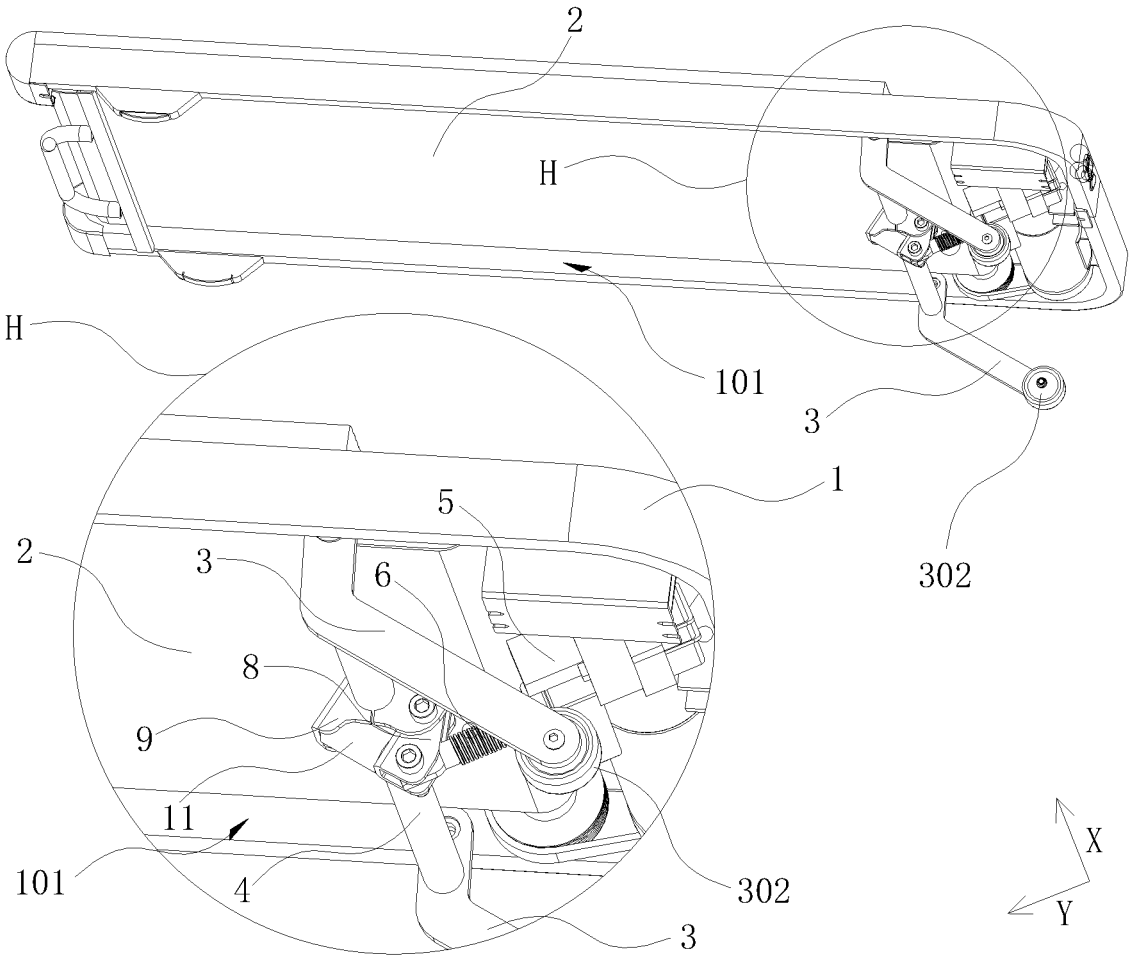
FIG. 8 is an axis-side schematic diagram of a second operation state of an electric lifting slop adjustment device having a vibration reduction function provided by a second embodiment of the present invention.

As shown in FIG. 5 to FIG. 8, a second embodiment of the present invention provides an electric lifting slope adjustment device having a vibration damping function. The electric lifting slope adjustment device having a vibration damping function is applied to a treadmill, the treadmill comprises a frame 1 and a running platform 2, the frame 1 is a rectangular frame and has a first inner wall 101, a second inner wall and a third inner wall 102, the first inner wall 101 and the second inner wall are arranged opposite each other, the third inner wall 102 is parallel to a first direction X and is perpendicular to the first inner wall 101 and the second inner wall respectively, and the running platform 2 is provided between the first inner wall 101 and the second inner wall; the electric lifting slope adjustment device having a vibration damping function comprises two lifting supports 3, a rotating shaft 4, a driving component and a vibration damping assembly; each of the lifting supports 3 has a rotating end 301, the rotating ends 301 of the two lifting supports are rotatably connected to the first inner wall 101 and the second inner wall respectively; the rotating shaft 4 extends along the first direction X, two ends of the rotating shaft 4 in an extending direction are respectively connected to the two lifting supports 3; the driving component is hinged to the third inner wall 102, the driving component comprises a lifting motor 5 and a lifting rod 6, the lifting rod 6 extends along a second direction Y, and a driving end of the lifting motor 5 is connected to the lifting rod 6, so that the lifting rod 6 can extend and retract reciprocally along an extending direction thereof; the vibration damping assembly comprises a mounting frame 9 and a vibration damping block 11, the mounting frame 9 is connected to the rotating shaft 4 and is hinged to an end portion of the lifting rod 6 close to the rotating shaft 4, the vibration damping block 11 extends along an axial direction perpendicular to the rotating shaft 4, and two ends of the vibration damping block 11 in the extending direction are respectively connected to the mounting frame 9 and the end portion of the lifting rod 6 close to the rotating shaft 4.

Optionally, the vibration damping block 11 made of a hard rubber material or a polyurethane material may be selected to replace the vibration damping spring 10, thereby achieving the vibration damping effect by means of elastic deformation of the vibration damping block 11.

Preferably, the vibration damping block 11 has a cylindrical block structure with an axis perpendicular to the axis of the rotating shaft 4, and two end faces of the vibration damping block 11 are respectively fixed to the mounting frame 9 and the hinging frame 8 by means of a pin structure.

A third embodiment of the present invention provides a treadmill. The treadmill comprises the electric lifting slope adjustment device having a vibration damping function provided by any one of the first embodiment and/or the second embodiment of the present invention.

From the above description, it can be seen that the above embodiments of the present disclosure achieve the following technical effects:

Compared with the prior art, when the electric lifting slope adjustment device having a vibration damping function provided by the first embodiment and/or the second embodiment of the present invention is in use, when the lifting motor 5 drives the lifting rod 6 to move along an extending direction thereof, the hinging frame 8 hinged to the end portion of the lifting rod 6 changes an angle, so as to drive the angle of the mounting frame 9 hinged to the hinging frame 8 to change; the mounting frame 9 drives the rotating shaft 4 to rotate, and finally drives the two lifting supports 3 connected to two ends of the rotating shaft 4 to rotate around their respective rotating ends 301, so as to achieve the angle adjustment of the running platform 2. During the angle adjustment process of the running platform 2, a vibration damping spring 10 or a vibration damping block 11 provided between the mounting frame 9 and the hinging frame 8 can counteract shaking generated during the angle adjustment by means of elastic compression. When the user applies pressure to the running platform 2, the vibration damping spring 10 or the vibration damping block 11 can also counteract the pressure transmitted from the rotating shaft 4 to the lifting motor 5 by means of elastic compression or elastic deformation, thereby prolonging the service life of the lifting motor 5.

The above description is only the preferred embodiments of the present invention, and is not intended to limit the present invention. For a person skilled in the art, the present invention may have various modifications and variations. Any modification, equivalent replacement, improvement, etc. made within the spirit and principles of the present disclosure should be included in the scope of protection of the present disclosure.

What is claimed is:

1. An electric lifting slope adjustment device having a vibration damping function applied to a treadmill, wherein the treadmill comprises a frame and a running platform, the frame is a rectangular frame and has a first inner wall, a second inner wall and a third inner wall, the first inner wall and the second inner wall are arranged opposite each other, the third inner wall is parallel to a first direction and is perpendicular to the first inner wall and the second inner wall respectively, and the running platform is provided between the first inner wall and the second inner wall; and wherein the electric lifting slope adjustment device having a vibration damping function comprises:

two lifting supports, each of the lifting supports having a rotating end, the rotating ends of the two lifting supports being rotatably connected to the first inner wall and the second inner wall respectively;

a rotating shaft extending along the first direction, two ends of the rotating shaft in an extending direction being respectively connected to the two lifting supports;

a driving component hinged to the third inner wall, the driving component comprising a lifting motor and a lifting rod, wherein the lifting rod extends along a second direction perpendicular to the first direction, and a driving end of the lifting motor is connected to the lifting rod, so that the lifting rod can extend and retract back and forth along an extending direction thereof; and a vibration damping assembly comprising a mounting frame and a vibration damping spring, wherein the mounting frame is connected to the rotating shaft and is hinged to an end portion of the lifting rod close to the rotating shaft, a compression direction of the vibration damping spring is perpendicular to an axis of the rotating shaft, and two ends of the vibration damping spring are respectively connected to the mounting frame and the end portion of the lifting rod close to the rotating shaft.

2. The electric lifting slope adjustment device having a vibration damping function according to claim 1, wherein the vibration damping assembly further comprises a hinging frame, the mounting frame has a first surface, the hinging frame has a second surface, one end of the hinging frame is hinged to the mounting frame so as to form a vibration damping space between the first surface and the second surface, the vibration damping spring is provided in the vibration damping space, two ends of the vibration damping spring in the compression direction are respectively connected to the first surface and the second surface, and the end portion of the lifting rod close to the rotating shaft is hinged to the other end of the hinging frame.

3. The electric lifting slope adjustment device having a vibration damping function according to claim 2, wherein the driving component further comprises a swinging sleeve, an inner portion of the swinging sleeve has a telescopic space, the telescopic space and the lifting rod extend in the same direction, the swinging sleeve is sleeved on an end portion of the lifting rod away from the rotating shaft, and an end portion of the swinging sleeve away from the rotating shaft is hinged to the third inner wall.

4. The electric lifting slope adjustment device having a vibration damping function according to claim 1, wherein each of the lifting supports comprises a first part and a second part, and an included angle is formed between the first part and the second part, the rotating end of each of the lifting supports is provided at an end portion of the first part away from the second part corresponding to the first part, a roller is rotatably connected to the second part of each of the lifting supports, and two ends of the rotating shaft in the extending direction are connected to the first parts of the two lifting supports respectively.

5. An electric lifting slope adjustment device having a vibration damping function applied to a treadmill, wherein the treadmill comprises a frame and a running platform, the frame is a rectangular frame and has a first inner wall, a second inner wall and a third inner wall, the first inner wall and the second inner wall are arranged opposite each other, the third inner wall is parallel to a first direction and is perpendicular to the first inner wall and the second inner wall respectively, and the running platform is provided between the first inner wall and the second inner wall; and wherein the electric lifting slope adjustment device having a vibration damping function comprises:

two lifting supports, each of the lifting supports having a rotating end, the rotating ends of the two lifting supports being rotatably connected to the first inner wall and the second inner wall respectively;

a rotating shaft extending along the first direction, two ends of the rotating shaft in an extending direction being respectively connected to the two lifting supports;

a driving component hinged to the third inner wall, the driving component comprising a lifting motor and a lifting rod, wherein the lifting rod extends along a second direction, and a driving end of the lifting motor is connected to the lifting rod, so that the lifting rod can extend and retract back and forth along an extending direction thereof; and a vibration damping assembly comprising a mounting frame and a vibration damping block, wherein the mounting frame is connected to the rotating shaft and is hinged to an end portion of the lifting rod close to the rotating shaft, the vibration damping block extends along an axial direction perpendicular to the rotating shaft, and two ends of the vibration damping block in the extending direction are respectively connected to the mounting frame and the end portion of the lifting rod close to the rotating shaft.

6. The electric lifting slope adjustment device having a vibration damping function according to claim 5, wherein the vibration damping assembly further comprises a hinging frame, the mounting frame has a first surface, the hinging frame has a second surface, one end of the hinging frame is hinged to the mounting frame so as to form a vibration damping space between the first surface and the second surface, the vibration damping block is provided in the vibration damping space, two ends of the vibration damping block in the extending direction are respectively connected to the first surface and the second surface, and the end portion of the lifting rod close to the rotating shaft is hinged to the other end of the hinging frame.

7. The electric lifting slope adjustment device having a vibration damping function according to claim 6, wherein the driving component further comprises a swinging sleeve, an inner portion of the swinging sleeve has a telescopic space, the telescopic space and the lifting rod extend in the same direction, the swinging sleeve is sleeved on an end portion of the lifting rod away from the rotating shaft, and an end portion of the swinging sleeve away from the rotating shaft is hinged to the third inner wall.

8. The electric lifting slope adjustment device having a vibration damping function according to claim 5, wherein the vibration damping block is made of an elastic hard material.

9. The electric lifting slope adjustment device having a vibration damping function according to claim 5, wherein each of the lifting supports comprises a first part and a second part, and an included angle is formed between the first part and the second part, the rotating end of each of the lifting supports is provided at an end portion of the first part away from the second part corresponding to the first part, a roller is rotatably connected to the second part of each of the lifting supports, and two ends of the rotating shaft in the extending direction are connected to the first parts of the two lifting supports respectively.

10. A treadmill comprising a frame and a running platform, wherein the frame is a rectangular frame and has a first inner wall, a second inner wall and a third inner wall, the first inner wall and the second inner wall are arranged opposite each other, the third inner wall is parallel to a first direction and is perpendicular to the first inner wall and the second inner wall respectively, and the running platform is provided between the first inner wall and the second inner wall; and wherein the electric lifting slope adjustment device having a vibration damping function comprises:

two lifting supports, each of the lifting supports having a rotating end, the rotating ends of the two lifting supports being rotatably connected to the first inner wall and the second inner wall respectively;

a rotating shaft extending along the first direction, two ends of the rotating shaft in an extending direction being respectively connected to the two lifting supports;

a driving component hinged to the third inner wall, the driving component comprising a lifting motor and a lifting rod, wherein the lifting rod extends along a second direction perpendicular to the first direction, and a driving end of the lifting motor is connected to the lifting rod, so that the lifting rod can extend and retract back and forth along an extending direction thereof; and a vibration damping assembly comprising a mounting frame and a vibration damping spring, wherein the mounting frame is connected to the rotating shaft and is hinged to an end portion of the lifting rod close to the rotating shaft, a compression direction of the vibration damping spring is perpendicular to an axis of the rotating shaft, and two ends of the vibration damping spring are respectively connected to the mounting frame and the end portion of the lifting rod close to the rotating shaft.

* * * * *